US011145500B2

(12) United States Patent
Cornish et al.

(10) Patent No.: US 11,145,500 B2
(45) Date of Patent: Oct. 12, 2021

(54) TIME OF FLIGHT MASS SPECTROMETER COUPLED TO A CORE SAMPLE SOURCE

(71) Applicant: Zeteo Tech, Inc., Sykesville, MD (US)

(72) Inventors: Timothy Cornish, Columbia, MD (US); Scott Ecelberger, Columbia, MD (US)

(73) Assignee: Zeteo Tech, Inc.

( * ) Notice: Subject to any disclaimer, the term of this patent is extended or adjusted under 35 U.S.C. 154(b) by 0 days.

(21) Appl. No.: 16/291,762

(22) Filed: Mar. 4, 2019

(65) Prior Publication Data

US 2019/0272986 A1 Sep. 5, 2019

Related U.S. Application Data

(60) Provisional application No. 62/637,714, filed on Mar. 2, 2018.

(51) Int. Cl.

| | |
|---|---|
| ***H01J 49/04*** | (2006.01) |
| ***H01J 49/00*** | (2006.01) |
| ***H01J 49/40*** | (2006.01) |

(52) U.S. Cl.

CPC ..... *H01J 49/0459* (2013.01); *H01J 49/0031* (2013.01); *H01J 49/40* (2013.01); *H01J 49/403* (2013.01)

(58) Field of Classification Search

CPC .... H01J 49/0031; H01J 49/0459; H01J 49/40; H01J 49/403

See application file for complete search history.

(56) References Cited

U.S. PATENT DOCUMENTS

| | | | |
|---|---|---|---|
| 5,464,985 | A | 11/1995 | Cornish et al. |
| 6,888,130 | B1 | 5/2005 | Gonin |
| 9,583,327 | B2 | 2/2017 | Cornish et al. |

(Continued)

FOREIGN PATENT DOCUMENTS

| | | | |
|---|---|---|---|
| GB | 2392305 | A | 2/2004 |
| WO | 2004/008470 | A2 | 1/2004 |
| WO | 2013/188555 | A1 | 12/2013 |

OTHER PUBLICATIONS

Getty et al., "Molecular Analyzer for Complex Refractory Organic-rich Surfaces (MACROS);" 978-1-5090-1613-6/17; 2017; IEEE; 11 pages.

*Primary Examiner* — Wyatt A Stoffa

(74) *Attorney, Agent, or Firm* — BakerHostetler

(57) ABSTRACT

In one aspect, a time-of-flight mass spectrometer includes a source comprising a backing plate configured to operably couple to a core sample containing component, and an acceleration region. The time-of-flight mass spectrometer also includes a time-of-flight mass analyzer operably associated with the source region. In some embodiments, the core sample core sample containing component is a coring drill bit. In some embodiments, core containing component is configured to couple to the backing plate of the source region from the opposite side of the acceleration region. In some embodiments, core containing component is configured to couple to the backing plate of the source region on the acceleration region side of the backing plate. In some embodiments, the acceleration region is a single-stage acceleration region. In other embodiments, the acceleration region is a two-stage acceleration region.

10 Claims, 12 Drawing Sheets

(56) References Cited

U.S. PATENT DOCUMENTS

| | | | | |
|---|---|---|---|---|
| 9,646,812 | B2 * | 5/2017 | Schmitz | H01J 49/0418 |
| 10,276,360 | B2 | 4/2019 | Cornish et al. | |
| 2002/0060289 | A1 | 5/2002 | Cornish et al. | |
| 2003/0047679 | A1 | 3/2003 | Cornish et al. | |
| 2004/0195501 | A1 | 10/2004 | Cornish | |
| 2008/0272289 | A1 | 11/2008 | Vestal | |
| 2010/0072363 | A1 | 3/2010 | Giles et al. | |
| 2010/0327157 | A1 | 12/2010 | Green et al. | |
| 2013/0032708 | A1 * | 2/2013 | Kern | H01J 49/02<br>250/281 |
| 2013/0161502 | A1 * | 6/2013 | Pomerantz | G01N 33/2823<br>250/255 |
| 2013/0337502 | A1 * | 12/2013 | Bo meyer | G01N 27/62<br>435/40.5 |
| 2014/0084155 | A1 | 3/2014 | Li et al. | |
| 2014/0208826 | A1 * | 7/2014 | Barter | G01J 3/42<br>73/23.41 |
| 2016/0225596 | A1 * | 8/2016 | Hayden | H01J 49/0495 |
| 2019/0048717 | A1 * | 2/2019 | Lu | G01N 33/241 |

* cited by examiner

TIME OF FLIGHT MASS SPECTROMETER COUPLED TO A CORE SAMPLE SOURCE

PRIORITY

This patent application claims the benefit under 35 U.S.C. § 119(e) of U.S. Patent Application No. 62/637,714, entitled "Time of Flight Mass Spectrometer Coupled to a Core Sample Source," filed on Mar. 2, 2018, which is incorporated herein by reference in its entirety.

U.S. GOVERNMENT LICENSE RIGHTS

This invention was made with U.S. government support under Grant No. NNG14HA57P awarded by the National Aeronautics and Space Administration. The U.S. government has certain rights in the invention.

FIELD

This disclosure relates generally to mass spectrometry and preparing samples for desorption and ionization.

BACKGROUND

Mass spectrometers can be used to identify numerous analytes. However, such devices can face significant difficulty in preparing samples for effective ionization. In particular, prepared samples from environmental sources, particularly core samples, are difficult to couple to mass spectrometer sources. The time of flight mass spectrometer disclosed herein addresses this and other problems.

SUMMARY

In one aspect, a time-of-flight mass spectrometer includes a source comprising a backing plate configured to operably couple to a core sample containing component, and an acceleration region. The time-of-flight mass spectrometer also includes a time-of-flight mass analyzer operably associated with the source region. In some embodiments, the core sample containing component is a coring drill bit. In some embodiments, core containing component is configured to couple to the backing plate of the source region from the opposite side of the acceleration region. In some embodiments, core containing component is configured to couple to the backing plate of the source region on the acceleration region side of the backing plate. In some embodiments, the acceleration region is a single-stage acceleration region. In other embodiments, the acceleration region is a two-stage acceleration region.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

A description of various aspects will now be made, in some instances with reference to the accompanying drawings. It should be understood that the following descriptions are not intended to limit the embodiments. To the contrary, it is intended to cover alternatives, modifications, and equivalents as can be included within the spirit and scope of the described embodiments as defined by the appended claims.

Mass spectrometry is an analytical technique for accurate determination of molecular weights, the identification of chemical structures, the determination of the composition of mixtures, and qualitative elemental analysis. In operation, a mass spectrometer generates ions of sample molecules under investigation, separates the ions according to their mass-to-charge ratio, and measures the relative abundance of each ion. A mass spectrometer generally includes a source region and a mass analyzer region. The source region can be any source designed to accelerate ions in a time-of-flight (TOEF) mass spectrometry.

Figure 1:
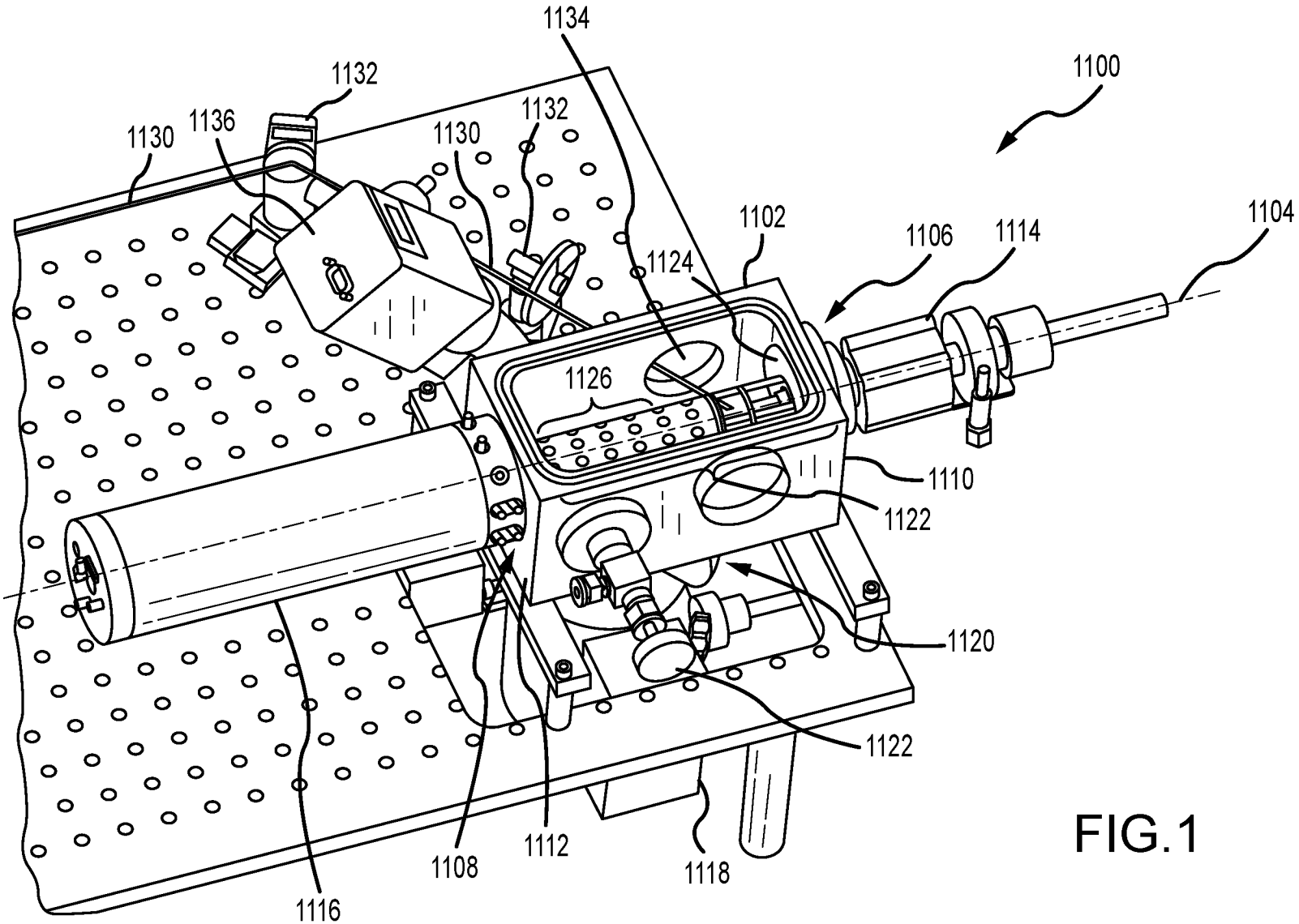
FIG. 1 is a perspective view is presented of a TOF mass spectrometer for analyzing a core sample, according to an illustrative embodiment.

Now referring to FIG. 1, a perspective view is presented of a TOF mass spectrometer 1100 for analyzing a core sample, according to an illustrative embodiment. The TOF mass spectrometer 1100 includes a vacuum chamber 1102 having a linear axis 1104 extending from a first port to a second port. The first port 1106 and second port 1108 may be disposed, respectively, in a first wall 1110 and a second wall 1112 of the vacuum chamber. A core sample-holding assembly 1114 is disposed through the first port 1106 and a reflectron 1116 is disposed through the second port 1108. The core sample-holding assembly 1114 serves as part of a source region for the TOF mass spectrometer 1100 and the reflectron 1116 functions as part of a mass analyzer region.

In the TOF mass spectrometer 1100 of FIG. 1, the core sample-holding assembly 1114 and the reflectron 1116 are coupled to the first port 1106 and the second port 1108, respectively, through a vacuum seal. The vacuum seal may be a compression seal that includes an O-ring or a metal gasket. However, other types of vacuum seals are possible. The first port 1106 and the second port 1108 are disposed opposite each other along the linear axis 1104 of the vacuum chamber 1102. As such, the first port 1106 and the second port 1108 align the core sample-holding assembly 1114 and the reflectron 1116 to face each other. Moreover, the linear axis 1104 provides a common longitudinal axis that is shared by the core sample-holding assembly 1114 and the reflectron 1116. During operation of the TOF mass spectrometer 1100, the linear axis 1104 serves as a pathway for analyte ions to travel from the sample-holding assembly 1114 to detectors in the reflectron 1116.

The TOF mass spectrometer 1100 also includes a vacuum pump 1118 coupled to a third port 1120 of the vacuum chamber 1102. The vacuum pump 1118 may be any type of pump capable of drawing a reduced pressure in the vacuum chamber 1102, and the coupling includes a vacuum seal. Non-limiting examples of vacuum pumps include a rotary-vane vacuum pump, a scroll pump, a turbomolecular pump, and a cryopump. The reduced pressure may be a pressure less than $10^{-3}$ torr, less than $10^{-4}$ torr, less than $10^{-5}$ torr, less than $10^{-6}$, and less than $10^{-7}$ torr. In some embodiments, the vacuum pump 1118 may include two vacuum pumps fluidly-coupled to the vacuum port 1120. In these embodiments, a first vacuum pump may be configured to produce a "rough" vacuum (e.g., $<10^{-3}$ torr) and a second vacuum pump may be configured to produce a "high" vacuum (e.g., $>10^{-5}$ torr).

TOF mass spectrometer 1100 may optionally include a venting valve coupled to a port within a wall of the vacuum chamber 1102. The venting valve is configured to displace from a first position, where a seal blocks an entry of gas into the vacuum chamber 1102, to a second position, where the seal is open and gas can exchange between the vacuum chamber 1102 and the ambient environment. During operation, the venting valve may allow reduced pressure in the vacuum chamber 1102 to be relieved (i.e., by equilibrating pressure with the ambient environment). Such relief may allow access to the vacuum chamber 1102 or removal of components therein (e.g., the coring drill bit).

Ion Source

In one aspect, a time-of-flight mass spectrometer includes an ion source, also referred to as a "source" or "source region." Referring again to FIG. 1, the source 1122 includes a backing plate 1124 configured to operably couple to a core sample-containing component. The source 1122 also includes an acceleration region 1126 through which ions are accelerated. In some embodiments, the source 1122 has a single-stage acceleration region. In other embodiments, the source 1122 has a two-stage acceleration region.

The source 1122 may be configured to employ any surface ionization method. Examples of such surface ionization methods including laser desorption, matrix assisted laser desorption/ionization (MALDI), atmospheric pressure MALDI (AP-MALDI), plasma desorption/ionization, and chemical ionization. In some variations, the ionization method and source is laser desorption. The laser can be any laser known for use in laser desorption, MALDI, or other desorption methods. Examples of such lasers including pulsed UV and IR lasers. Examples of such lasers include nitrogen lasers and Nd:YAG lasers, among others. The device can also be adapted to laser ablation methods.

In FIG. 1, a laser (not shown) is configured to be incident on a core sample mounted onto the core sample-holding assembly. The core sample can be contained in a core sample-containing component, such as a core drill bit. The laser may include an optical assembly 1128 (e.g., one or more lenses, mirrors, etc.) for focusing a beam of electromagnetic radiation 1130 onto the core sample. The optical assembly 1128 may help define a beam pathway extending from the laser to the core sample. During operation, the laser produces the beam of electromagnetic radiation 1130, which is absorbed by the core sample (or portion thereof). The laser induces material from the core sample to desorb and ionize. In some variations, a plume of material may be ejected from the core sample that includes neutral and ionized chemical constituents. Non-limiting examples of such chemical constituents include elements, molecules, and fragments of molecules. Other types of chemical constituents are possible.

The backing plate 1124 can be coupled to the core sample-containing component. In some variations, the backing plate 1124 is coupled to the core sample-containing component by a mount. The mount secures the core sample-containing component such that the core sample is positioned such that the laser is incident on the core sample during operation. In some embodiments, the core sample-containing component is a coring drill bit.

In various aspects, the mount may include an orifice for receiving the core sample-containing component. The mount may also include a mechanical locking mechanism for securing the core sample-containing component on the mount (e.g., a set screw, a chuck, a collet, a ferrule, a compression ring, etc.).

Figure 2A:
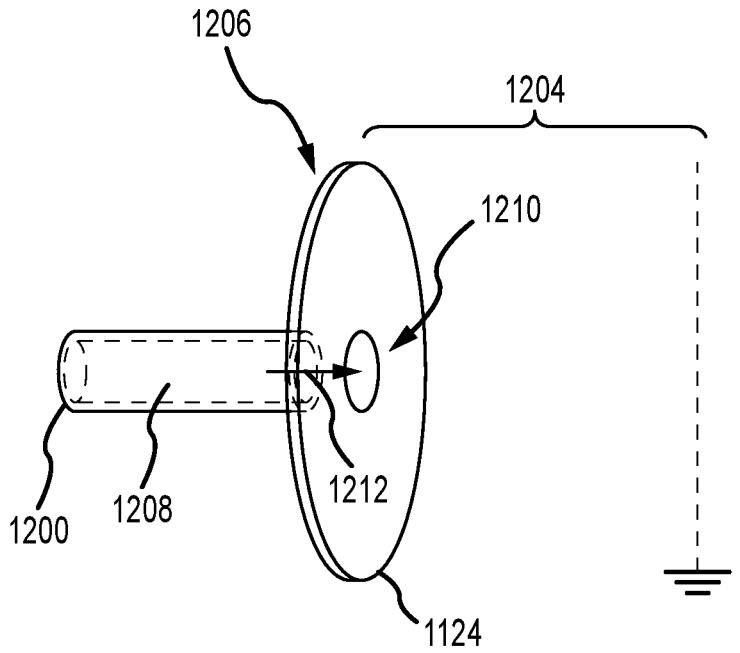
FIG. 2A is a schematic diagram of a core sample-containing component coupled to a backing plate on a side opposite a source region, according to an illustrative embodiment.

FIG. 2A depicts a variation in which a core sample-containing component 1200 is coupled to a backing plate 1124 of a source region 1204 from an opposite side 1206 of the source region 1204 (i.e., a non-ion acceleration side of the backing plate 1124). Arrow 1208 indicates a motion of the core sample-containing component 1200 to achieve such coupling. The core sample-containing component 1200 may contain a core sample disposed therein, and may couple to the backing plate 1124 via an orifice 1210. Arrow 1212 indicates a representative motion of the core sample-containing component 1200 to achieve such coupling. In some variations, the orifice 1210 includes a bore disposed through at least a portion of the backing plate. The core sample-containing component 1200 may be placed within the bore and optionally secured by the mechanical locking mechanism (not shown).

Figure 2B:
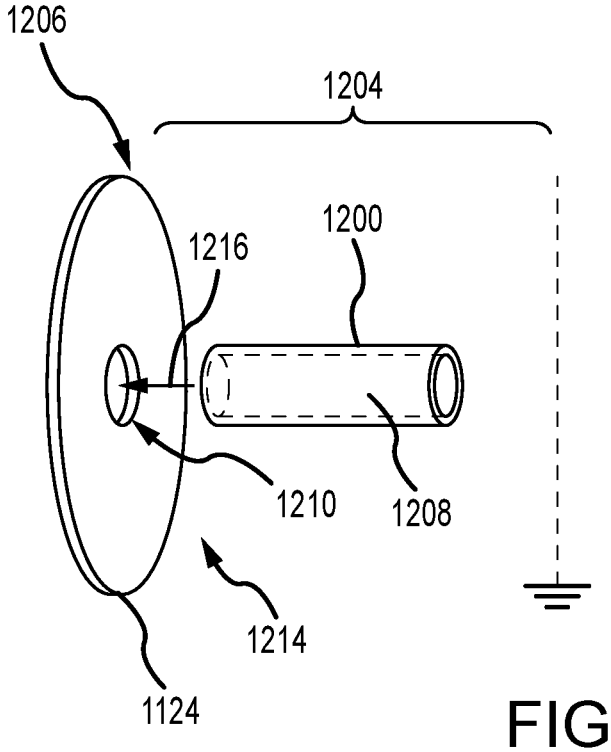
FIG. 2B is a schematic diagram of a core sample-containing component coupled to a backing plate from within a source region, according to an illustrative embodiment.

FIG. 2B depicts a variation in which the core sample-containing component 1200 is coupled to the backing plate 1124 of the source region 1204 from within the source region 1204 (i.e., the ion acceleration side of the backing plate 1124). The core sample-containing component 1200 is inserted into the source region 1204 from a front 1214 of the backing plate 1124. Arrow 1216 indicates a representative motion of the core sample-containing component 1200 to achieve such insertion. Similarly, in some variations, the orifice 1210 includes a bore disposed through at least a portion of the backing plate. The core sample-containing component 1200 may be placed within the bore and optionally secured by the mechanical locking mechanism (not shown).

The backing plate 1124 allows the core sample-containing component to couple to the source of the time-of-flight mass spectrometer 1100, either directly or through an adapter. The core sample-containing component may be placed within a chamber of the source 1122 (e.g., vacuum chamber 1102), or alternatively, be mounted through a wall of the chamber.

To acquire sample material, the core sample-containing component (e.g., a coring drill bit) may be used to extract sample material from a target body. When the core sample-containing component is a coring drill bit, the bit can be coupled to a source of rotary motion such as an electric motor with a chuck. While rotating, the coring drill bit can be pressed against a surface of the target body, causing a rotating circular edge of the coring drill bit to cut into the target body. Friction between the target body and the rotating circular edge causes sample material to collect within the coring drill bit. The sample material may be a monolithic cylindrical body or a compacted aggregate of particles (e.g., a compacted power or dust). After sufficient sample material has been extracted, the coring drill bit is pulled away from the targeted body and de-coupled from the source of rotary motion.

In various embodiments the time-of-flight mass spectrometer 1100 is capable of detecting any analyte, particularly non-volatile (refractory) and hard materials. The time-of-flight mass spectrometer 1100 can be configured to act as a laser ablation mass spectrometer for detection of non-volatile compounds in planetary exploration and field-portable terrestrial applications. In certain embodiments, the time-of-flight mass spectrometer 1100 is configured to identify analytes taken from mining operations. Such operations may include the extraction of core samples within a mine tunnel, analysis of core samples within the mine tunnel, or both. The operations may also include above-ground extraction and analysis of samples taken from exploratory down-hole drilling.

In various aspects, the coring drill bit may be configured to match the target body of interest. For example, and without limitation, the coring drill bit may be a diamond-coated coring drill bit having a 1.5 mm inside diameter and the target body may be a rock (e.g., a mineral, a clay sample, etc.). The coring drill bit may be rotated from 100 to 600 revolutions per minute and pressed up against the rock to acquire sample material. Upon removal from the rock, the coring drill bit contains a compacted powder within its central bore. The coring drill bit may also have an exposed flat surface of compacted mineral powder at its cutting end.

Now referring back to FIG. 1, the TOF mass spectrometer 1100 additionally includes a laser (not shown) configured to desorb and ionize material from a core sample. The core sample is disposed in the sample-holding assembly 1114, and the laser is configured to be incident on the core sample. The laser is disposed at an originating end of an optical pathway that extends to the sample material. The sample material sits at a terminating end of the optical pathway. During operation, the laser emits a pulse or beam of electromagnetic radiation 1130 that travels along the optical pathway from the originating end to the terminating end. Optical elements 1132, such lenses, mirrors, diffractive gratings, and choppers, may be used to define the optical pathway. However, this depiction is not intended as limiting.

The laser may be displaced from the TOF mass spectrometer 1100, or alternatively, coupled directly thereto. In embodiments where the laser is displaced from mass spectrometer, such as shown in FIG. 1, the optical pathway may traverse an optical window 1134. The optical widow 1134 may be disposed within an orifice of the vacuum chamber 1102 and coupled thereto with a vacuum seal. The optical window 1134 is formed of material transparent to the beam of electromagnetic radiation 1130 emitted by the laser. In embodiments where the laser is coupled directly to the TOF mass spectrometer 1100, the laser may be coupled to a port disposed in a wall of the vacuum chamber 1102. In these embodiments, the optical pathway is contained entirely within the vacuum chamber.

In some embodiments, the TOF mass spectrometer 1100 includes a vacuum gauge 1136. The vacuum gauge 1136 may be electrically-coupled to a system for monitoring reduced pressures in the vacuum chamber 1102. The vacuum gauge 1136 may be coupled to a port within a wall of the vacuum chamber 1102, such as through a vacuum seal. Non-limiting examples of the vacuum gauge 1136 include a capacitive manometer, a Pirani gauge, a piezoelectric gauge, a hot filament ion gauge, a thermocouple gauge, and cold cathode gauge. Other types of vacuum gauges are possible, including combinations of gauges.

Figure 3:
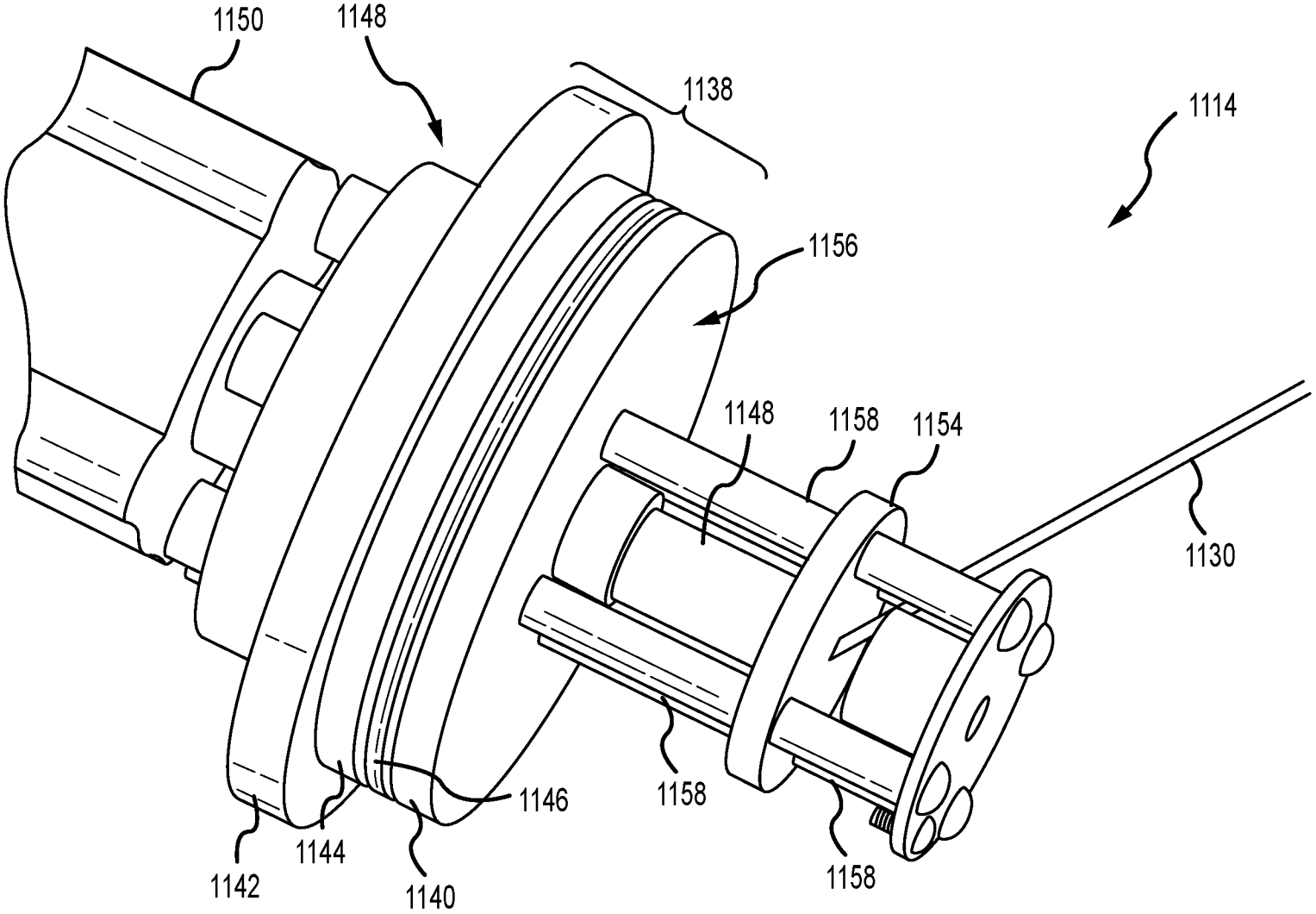
FIG. 3 is a perspective view of the core sample-holding assembly of FIG. 1, according to an illustrative embodiment.

Now referring to FIG. 3, a perspective view is presented of the core sample-holding assembly 1114 of FIG. 1, according to an illustrative embodiment. The core sample-holding assembly 1114 includes an adapter 1138 configured to fit within the first port 1106 of the vacuum chamber 1102. The adapter 1138 may by cylindrically-shaped, as shown in FIG. 3. The adapter 1138 includes a first perimeter 1140 and a second perimeter 1142. The second perimeter 1142 is larger than the first perimeter 1140 such that the adapter 1138 fits only partially within the first port 1106 of the vacuum chamber 1102. A surface 1144 is disposed around the first perimeter 1140 and is configured to mate with a receiving surface of the first port 1106. The first surface 1144 includes a gland configured to hold an O-ring 1146. When the adapter 1138 is inserted within the first port 1106, the O-ring 1146 is compressed against the receiving surface of the first port 1106 and surfaces of the gland, thereby forming the vacuum seal. A laser is configured to be incident on the core sample.

The adapter 1138 also includes a thru-bore configured to allow a core sample carrier 1148 to be inserted through the adapter 1138. The thru-bore may be cylindrically-shaped, as shown in FIG. 3. The core sample carrier may include a rod, the end of which includes a backing plate. The adapter additionally includes a motion-tolerant vacuum seal 1150 coupled to an exterior-facing surface 1152 of the adapter 1138. The motion-tolerant vacuum seal 1150 allows the core sample carrier 1148 to displace linearly along the linear axis 1104 of the vacuum chamber 1102, but while maintaining a seal capable of supporting a vacuum. Such displacement is used to position core the sample-containing component at the terminating end of the optical pathway.

The adapter 1138 additionally includes a stop plate 1154 displaced from an interior-facing surface 1156 of the adapter 1138. The stop plate 1154 is operable to stop insertion of the core sample carrier 1148 into the vacuum chamber 1102, thereby positioning the coring drill bit at the terminating end of the optical pathway. The stop plate 1154 may be displaced from the interior-facing surface 1156 of the adapter by a plurality of support rods 1158.

Figure 4A:
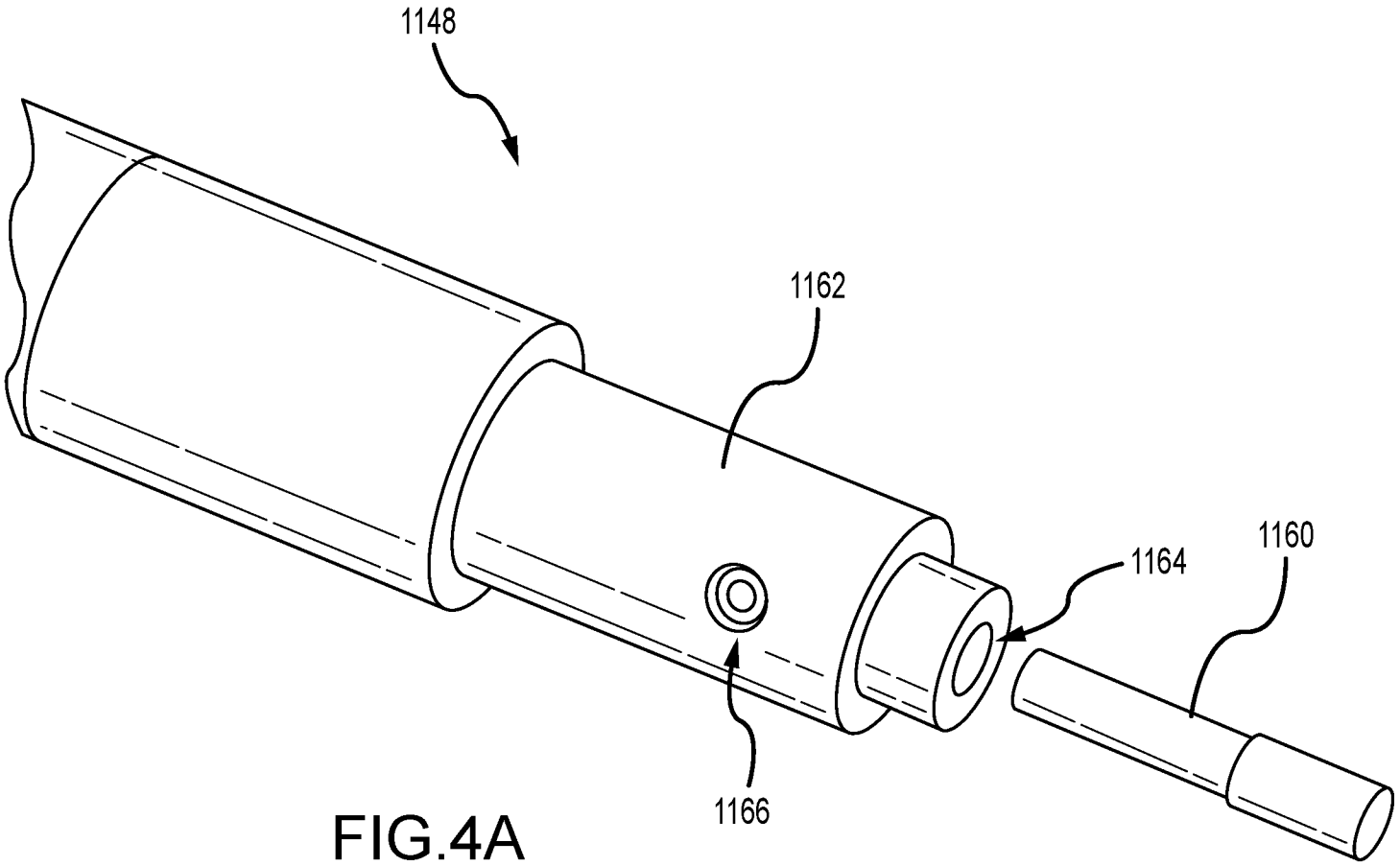
FIG. 4A is a perspective view is presented of a core sample carrier for the core sample-holding assembly of FIG. 3, according to an illustrative embodiment.

Now referring to FIG. 4A, a perspective view is presented of the core sample carrier 1148 for the core sample-holding assembly 1114 of FIG. 3, according to an illustrative embodiment. The core sample carrier 1148 secures a core sample-containing component 1160 for insertion into (and retraction from) the vacuum chamber 1102 of the TOF mass spectrometer 1100. The core sample carrier 1148 may be a rod having a backing plate 1162 disposed at one end. The backing plate 1162 is configured such that the core sample-containing component 1160 selectively protrudes past the one end of the core sample carrier 1148. In many embodiments, such as shown in FIG. 4A, the backing plate 1162 may be cylindrically-shaped.

The backing plate 1162 may include an orifice 1164 for receiving the core sample-containing component 1160, and may also include a mechanical locking mechanism 1166 for securing the core sample-containing component 1160 within the orifice 1164. In some variations, such as shown in FIG. 4A, the orifice 1164 includes a bore disposed through at least a portion of the backing plate 1162. In these embodiments, the core sample-containing component 1160 may be placed within the bore and secured by the mechanical locking mechanism 1166. FIG. 4A depicts the mechanical locking mechanism 1166 as a set screw. However this depiction is not intended as limiting. Other types of mechanical locking mechanisms are possible, including a chuck, a collet, a ferrule, a compression ring, and so forth.

In some variations, the interior of the core sample-containing component 1160 can be configured to be truncated or blocked such that it is not completely hollow. A small cavity at one end of core sample-containing component 1160 can then be configured to contain the sample (e.g., powder sample). In variations, the sample in the core sample-containing component 1160 is further compacted by further drilling. The core sample component can then be placed into the mass spectrometer.

In some embodiments, the core sample-containing component 1160 is a coring drill bit. The coring drill bit may be configured as a thin metallic tube having a bore therein. The coring drill bit includes a cutting end coated with an abrasive material capable of cutting into hard bodies, such those represented by rocks and minerals. Non-limiting examples of the abrasive material include diamond, aluminum oxide, silicon nitride, silicon carbide, boron nitride, boron carbide, tungsten carbide, titanium nitride, and so forth. The coring drill bit has an inner diameter that corresponds to a diameter of the bore. The inner diameter (or ranges therefor) may be selected according to a target body from which a core sample will be extracted. The inner diameter may ensure that the core sample exhibits a form suitable for the TOF mass spectrometer, such as a compacted powder.

In some embodiments, the inner diameter is 3 mm. In some embodiments, the inner diameter is 2.5 mm. In some embodiments, the inner diameter is 2.0 mm. In some embodiments, the inner diameter is equal to or less than 1.5 mm. In some embodiments, the inner diameter is equal to or less than 1.0 mm. In some embodiments, the inner diameter is equal to or less than 0.5 mm.

In some embodiments, the inner diameter is equal to or less than an upper limit. In some embodiments, the inner diameter is equal to or less than 3 mm. In some embodiments, the inner diameter is equal to or less than 2.5 mm. In some embodiments, the inner diameter is equal to or less than 2 mm. In some embodiments, the inner diameter is equal to or less than 1.5 mm. In some embodiments, the inner diameter is equal to or less than 1 mm.

In some embodiments, the inner diameter is equal to or greater than a lower limit. In some embodiments, the inner diameter is equal to or greater than 0.5 mm. In some embodiments, the inner diameter is equal to or greater than 1.0 mm. In some embodiments, the inner diameter is equal to or greater than 1.5 mm. In some embodiments, the inner diameter is equal to or greater than 2.0 mm. In some embodiments, the inner diameter is equal to or greater than 2.5 mm.

The upper and lower limits may be combined as described above to define a range for the inner diameter. For example, the inner diameter may be equal to or greater than 0.5 mm but equal to or less than 1.5 mm. In another non-limiting example, the inner diameter may be equal to or greater than 2.0 mm but equal to or less than 2.5 mm. In still yet another non-limiting example, the inner diameter may be equal to or greater than 1.0 mm but equal to or less than 3.0 mm.

Figure 4B:
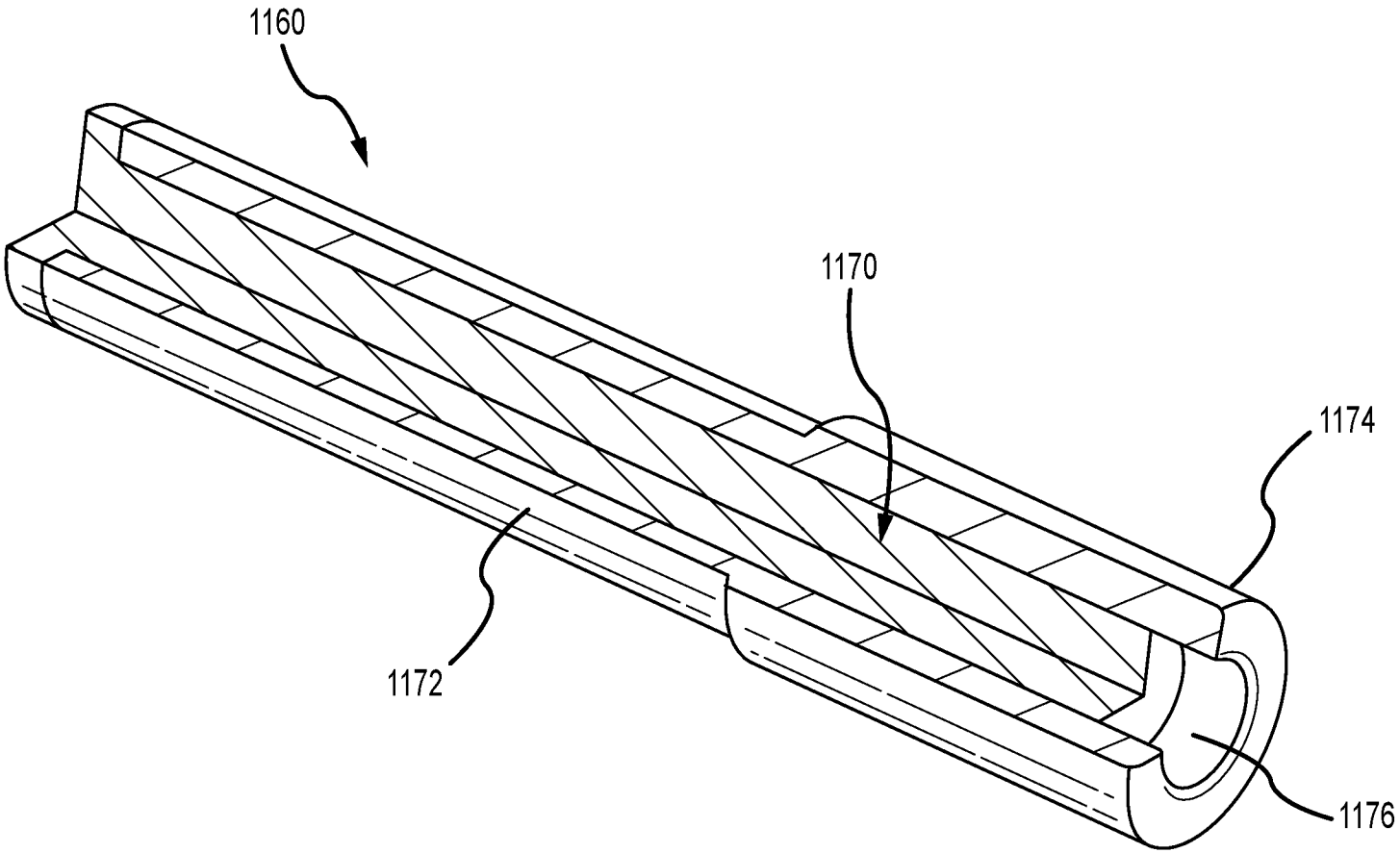
FIG. 4B is a perspective view of a core sample-holding assembly in FIG. 4A, according to an illustrative embodiment.

FIG. 4B depicts an exploded view of one such variation of core sample-containing component 1160. Pin 1170 is inserted into the center core sample component 1160, creating cavity 1176 for the mineral powder to accumulate in the tip of the drill. Pin 1170 is fitted into hollow coring drill body 1172 affixed with drill tip 1174 (e.g., a diamond abrasive tip) such that a powder sample can be contained in cavity 1176. In various aspects, pin 1170 is flush with the inner diameter of core sample-containing component 1160. Pin 1170 can be formed of any suitable material, including brass, stainless steel, and the like.

The sample, e.g., a powder sample, can be compacted in the core sample containing component 1160. The sample can be detected directly when core sample containing component 1160 is placed in a mass spectrometer. The sample is flush with the source "backing plate." The backing plate, broadly understood, is the end of the source region on which the ionization radiation is incident. The "backing plate" maintains a voltage and is opposite to a grounded grid on the opposite side of the source region. The core sample containing component abuts the backing plate of the ion source such that the sample in the core sample containing component is flush with the source backing plate in such a position to be ionized, e.g., by source radiation such as a pulsed laser.

In various aspects, the flatness of the sample flush with the backing plate allows for increased mass resolution. Variations on the surface of the sample can cause ionization at different locations within the source region. Ions formed at different locations in the source region are accelerated to different energies, which will be detected at different times, resulting in a loss of resolution.

How "flush" a sample is can be measured as a tolerance—how much the surface flatness varies. In some variations, the sample in the sample-containing component has a surface tolerance of 25 microns. In some variations, the sample in the sample-containing component has a surface tolerance of 50 microns. In some variations, the sample in the sample-containing component has a surface tolerance of 100 microns. In some variations, the sample in the sample-containing component has a surface tolerance of 150 microns. In some variations, the sample in the sample-containing component has a surface tolerance of 200 microns. In some variations, the sample in the sample-containing component has a surface tolerance of 250 microns. In some variations, the sample in the sample-containing component has a surface tolerance of 300 microns.

Further, the device and methods herein do not require sample pre-processing. In many methods of sample detection, a slurry or dissolved sample must be made and placed in the source region. In the devices and methods of the disclosure, samples can be added from their origin (e.g., a rock sample) directly into the mass analyzer without pre-processing steps such as removing the sample from the sample-containing component (e.g., drill bit), dissolving a sample, creating a sample slurry, and the like.

Compacting the sample allows the mass spectrometer to maintain mass analyzer vacuum pressure (and not substantially diminish mass analyzer vacuum pressure) due to the presence of un-compacted powder within the mass spectrometer.

Mass Analyzer

In another aspect, a time-of-flight mass spectrometer includes a time-of-flight mass analyzer operably associated with the source region. The time-of-flight mass analyzer separates ions according to their mass-to-charge ratio by measuring the time it takes generated ions to travel to a detector. The time-of-flight mass analyzer is advantageous because it is a relatively simple, inexpensive instrument with a virtually unlimited range for mass-to-charge ratios.

The time-of-flight mass analyzer is operably associated with the source, which generates ions of sample material under investigation. The source contains one or more electrodes or electrostatic lenses for accelerating and properly directing an ion beam. In the simplest case, the electrodes are grids. The time-of-flight mass analyzer may include a detector. The detector is positioned at a predetermined distance from a final grid for detecting ions as a function of time. Generally, a drift region exists between the final grid and the detector. The drift region allows the ions to travel a predetermined distance in free flight before they impact the detector.

The flight time of an ion accelerated by a given electric potential is proportional to its mass-to-charge ratio. Thus, the time-of-flight of an ion is a function of its mass-to-charge ratio, and is approximately proportional to the square root of the mass-to-charge ratio. Assuming the presence of only singly-charged ions, the lightest group of ions reaches the detector first and is followed by groups of successively heavier mass groups.

Figure 5:
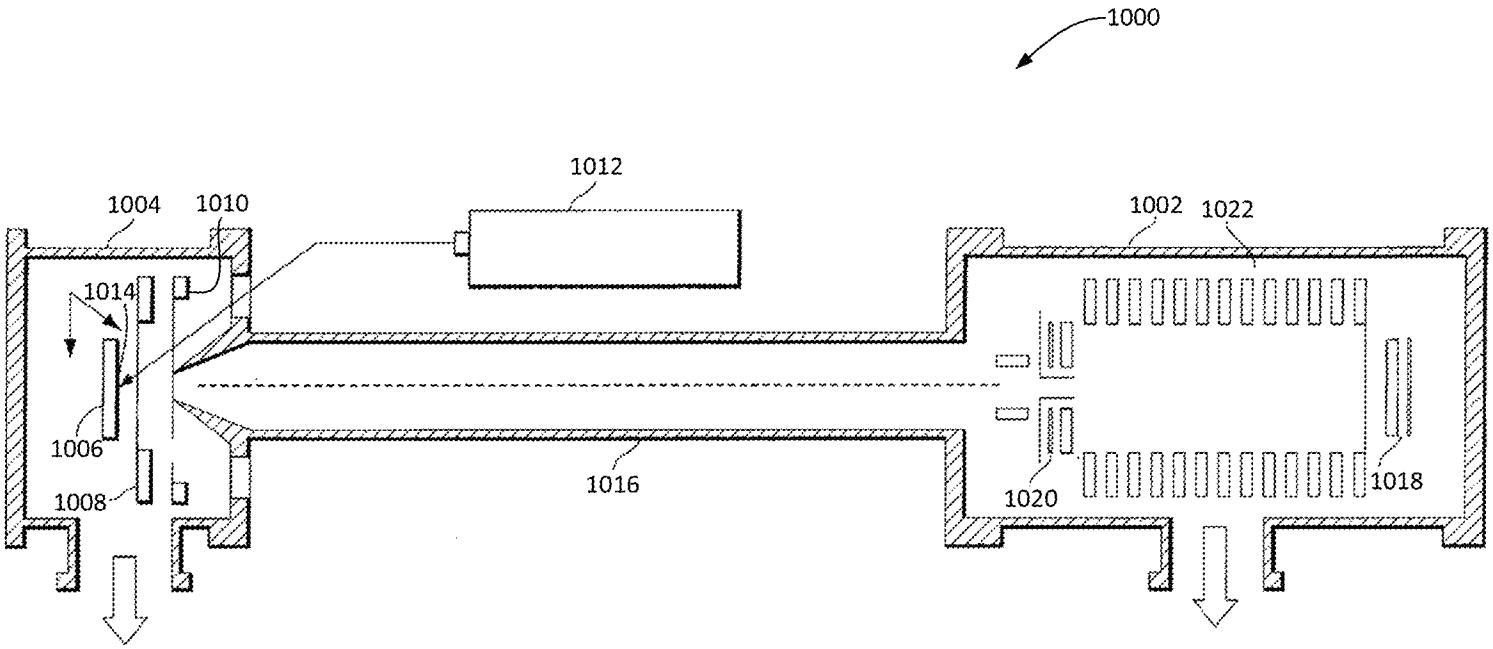
FIG. 5 is a schematic diagram of a laser (or desorption) TOF mass spectrometer having a single-stage ion reflector, according to an illustrative embodiment.

Now referring to FIG. 5, a schematic diagram is presented of a laser (or desorption) TOF mass spectrometer 1000 having a single-stage ion reflector 1002, according to an illustrative embodiment. The TOF mass spectrometer 1000 can include a two-field ion source 1004 with a holder 1006 and a first 1008 and second 1010 element, or a single field ion source (not shown). The holder 1006 may include a backing plate, such as that described in relation to FIGS. 2A & 2B. Power supplies (not shown) are electrically connected to the holder 1006 and the first 1008 and second 1010 elements such that the electric field between the first element 1008 and the holder 1006 is variable before ion extraction. TOF mass spectrometer 1000 also includes a laser 1012 for ionizing and desorbing sample ions. A sample 1014 is proximately disposed to the holder 1006. The sample 1014 may include a matrix molecule that is highly absorbing at the wavelength of the laser 1012. The matrix molecule facilitates desorption and ionization of the sample 1014.

The TOF mass spectrometer 1000 can include a reflectron. Reflectrons (also called ion mirrors) are also used to compensate for the effects of the initial kinetic energy distribution. An ion reflector is positioned at the end of the free-flight region. An ion reflector can include one or more homogeneous, retarding, electrostatic fields. As the ions penetrate the reflector, with respect to the electrostatic fields, they are decelerated until the velocity component in the direction of the field becomes zero. Then, the ions reverse direction and are accelerated back through the reflector. The ions exit the reflector with energies identical to their incoming energy but with velocities in the opposite direction. Ions with larger energies penetrate the reflector more deeply and consequently will remain in the ion reflector for a longer time. In a properly designed reflector, the potentials are selected to modify the flight paths of the ions such that ions of like mass and charge arrive at the detector at the same time regardless of their initial energy.

Figure 6:
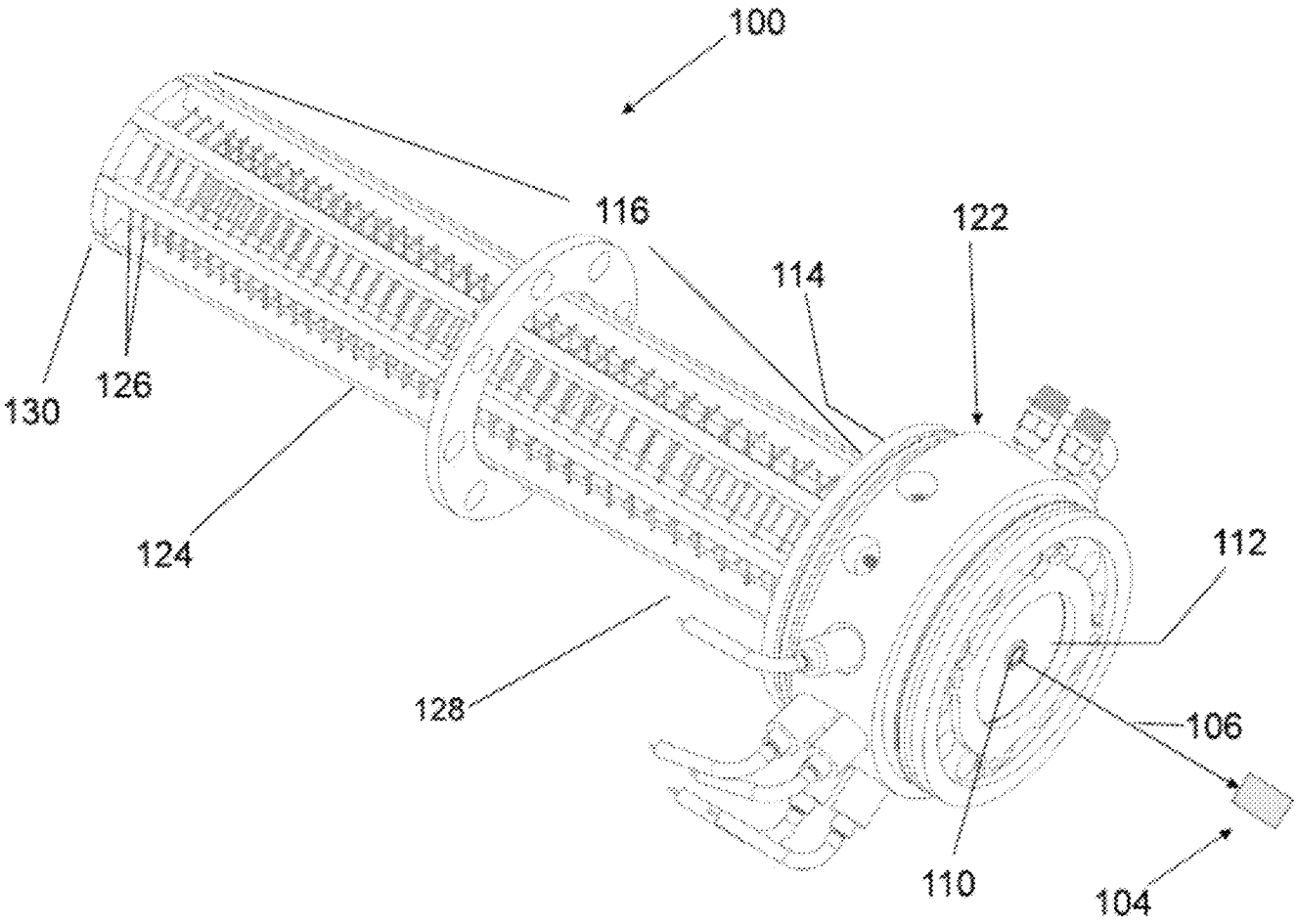
FIG. 6 is a three dimensional cut-away view of one aspect of a miniature TOF-MS, according to an illustrative embodiment.

FIG. 6 depicts a three dimensional cut-away view of one aspect of a miniature TOF-MS 100, according to an illustrative embodiment. The entire mass spectrometer is evacuated to high vacuum (at, or lower than, $1\times10^{-6}$ torr). A non-volatile sample (not shown) is introduced into the source region 104, where a pulsed laser beam 106 impinges on the sample surface (not shown). As depicted in FIG. 6, the laser beam 106 is directed down the center axis 110 of the miniature TOF-MS instrument 100, though it is contemplated that the beam can come from any direction such as from a side or diagonal position. Ions are created, and are subsequently accelerated towards the drift region by fixed or pulsed high voltage potentials. Lighter mass ions achieve the highest velocity, and reach a linear detector 112 or a reflectron detector 114 first, while the heavier mass ions arrive at the detector at a later time. The mass of the ion is determined by squaring the arrival time of that particular mass ion at the detector, and multiplying by a constant, a value characteristic of that particular analyzer.

In the linear detector 112, ions travel for a shorter time between leaving the source region 104 and reaching the detector 112, which results in lower resolution of mass peaks. Longer flight times, and increased mass resolution, can be achieved if the ions are allowed to enter the reflectron 116 (sometimes called a "ion reflector" or "ion mirror"). Here, the flight path is effectively doubled, and the flight times are increased (e.g. by a factor of 4) due to the gradual slowing and reversing of the ion path through the reflectron 116. If a particular mass is to be isolated for advanced analysis (e.g. characterization of molecular ion fragmentation), the ion gate (not shown, inside detector block 122) is pulsed, allowing only selected mass ions to pass through the gate and continue towards the linear detector 112 or reflectron detector 114.

In various embodiments, the miniature TOF-MS is capable of detecting any analyte, particularly non-volatile (refractory) and biological materials. The present miniature TOF-MS can be configured to act as a laser ablation mass spectrometer for detection of non-volatile compounds in planetary exploration and field-portable terrestrial applications.

The instrument can be any length, and can be as small as 1 inch, 2 inches, 3 inches, 4 inches, 5 inches, 6 inches, 7 inches, 8 inches, 9 inches, 10 inches, 11 inches, or 12 inches in length.

Aspects of the present miniature TOF-MS are described in more detail herein. It is contemplated that each component can be used as a unit with the components disclosed in FIG. 6, or separately and with any other TOF-MS instrument known in the art.

In some embodiments, the source can be any surface desorption method, including matrix assisted laser desorption/ionization (MALDI), AP-MALDI, plasma desorption/ionization, chemical ionization, and/or other types of surface ionization. The laser can be any laser known for use in MALDI or desorption methods, including pulsed UV or IR lasers. The device can also be adapted to laser ablation methods.

The focusing optics can include any focusing optics suitable for an ion beam, including ion focusing elements (e.g. einzel lens).

Figure 7:
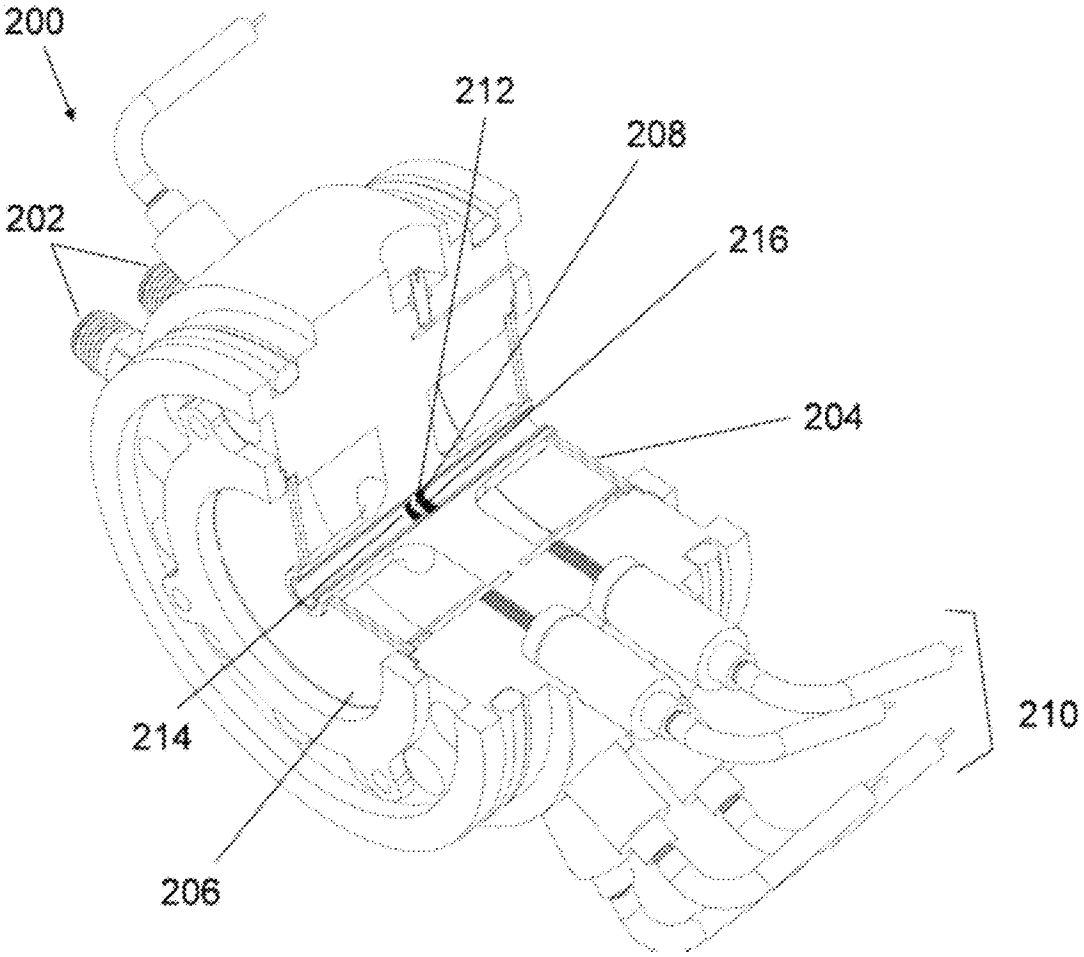
FIG. 7 is a detail view, shown in perspective, of the detector block of FIG. 6, according to an illustrative embodiment.

The detector block 122 depicted in FIG. 6 is shown in more detail in FIG. 7. The detector block 200 also incorporates all of the vacuum feedthroughs 202 for the application of high voltage to the internal components within the evacuated instrument. Specifically, the detector block 200 is a unitary detector block in which all components, including linear detector 204 and reflectron detector 206, pulsed pin ion gate 208 that includes a pin 212 and two grids (Grid A 214 and Grid B 216), HV feedthroughs 210, and detector anodes. The unitary construction provides greater rigidity to impact, while including all components in the mass spectrometer. The combination of components simplifies assembly and repair of the analyzer. As depicted in FIG. 6, vacuum "cans" (i.e. sleeves with sealed ends) are sealed onto o-rings located in the detector housing block. All high voltage leads are attached to the vacuum housing at the center of the instrument. Consolidating the complexity of the electronics and feedthroughs into a single central detector block also reduces fabrication costs.

A pulsed pin ion gate 300 is embedded into the center of the detector block. The ion gate allows for removal (i.e. gating) of ions having particular ion mass or range of ion masses for further analysis.

Figure 8:
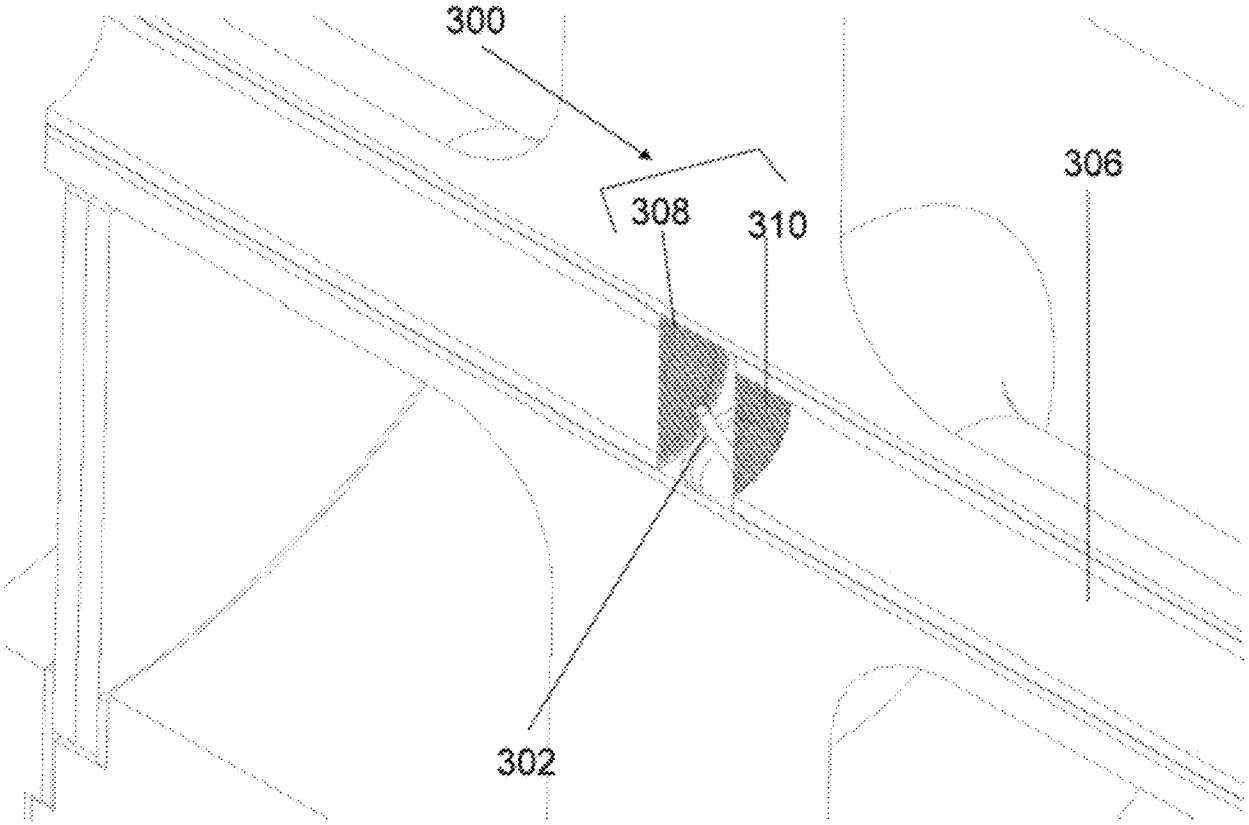
FIG. 8 is a cross-section view, shown in perspective, of a pulsed pin ion gate, according to an illustrative embodiment.

Ion gates allow the passage of ions in a selected mass range. As depicted in FIG. 8, an electrically isolated pin 302 is inserted into the detector block and protrudes into the ion flight path 306. Two high transmission grids A 308 and B 310 are disposed at two locations in the ion flight path 306 on either side of the ion gate 300. Grid A 308 is disposed in the ion flight path 306 proximal to the source region 316 from the pin 302, and grid B 310 is disposed distal from the source region (not shown) on the other side of the pin 302. Grid A 308 and grid B 310 keep the pulse pin potential from propagating into the flight tube beyond the grid A 308 and grid B 310, thereby allowing narrower mass selection of ions in the ion beam.

When the pin 302 is at the same potential as the ion flight path 306 and grids 308 and 310, ions do not deviate from their trajectory in the ion flight path 306. When the pin 302 is at a different potential from the ion flight path 306, ions deviate from their trajectory, and do not reach the reflectron detector 314. By timing the pin 302 to have the same potential as the ion flight path 806 when specific ions pass through the ion gate 300 and a different potential when unwanted ions pass through the ion gate 300, specific ions or groups of ions can be selected for further analysis.

In various embodiments, the grids 308 and 310 are high transmission grids. In various embodiments, the transmission efficiency can be 80%, 85%, 88%, or 90%. The grids 308 and 310 can be constructed of any suitable material known in the art, for example nickel mesh material.

A pulse potential can be applied to the pin 302 of the ion gate 300 by any means known in the art. In various embodiments, the pin 302 is connected to a pulse generator that generates a pulse potential. In various embodiments, the pulse can be a square wave. The pulse time can be any time induced by control electronics. In some aspects the pulse width can be 25 ns, 50 ns, 75 ns, 100 ns, 130 ns, 150 ns, 170 ns, 200 ns, 250 ns, 300 ns, 350 ns, 400 ns, 450 ns, 500 ns, 550 ns, 600 ns, 650 ns, 700 ns, 750 ns, 800 ns, 850 ns, 900 ns, 950 ns, or 1000 ns.

The ion gate 300 can be used to gate out all masses below a specific mass. Alternatively, masses above a certain mass can be gated out. In some instances, more than one mass range can be selected, by for example, using a quick-recovery pulse generator.

The pin 302 in a pulse pin gate can be any type of conductive material inserted close to the ion flight path 306. The pulse pin can be any shape (e.g., having a circular or square cross-section) provided that it causes ions to diverge from the ion beam when the pin is pulsed at a different potential from the drift region and grids. As long as the pin is configured to affect the ion beam when the pin is pulsed, the pin can be disposed at any position relative to the drift region. In various non-limiting embodiments, the pulsed pin can protrude into the drift channel of the detector assembly, be held on flush with the edge of the drift tube, be withdrawn from the drift tube, or extend directly into the ion beam.

In various embodiments, grids A 306 and grid B 308 are spaced apart by a defined distance. More narrowly spaced grids allow a narrower packet of ion masses to be selected by the gate. In some instances, the space separating the grid is 1.0 mm, 1.5 mm, 2.0 mm, 2.5 mm, 3.0 mm, 3.5 mm, 4.0 mm, 5.0 mm, 6.0 mm. 7.0 mm, 8.0 mm, 9.0 mm, or 10.0 mm. Since the tubes (and grids) are held at the drift potential, application of high voltage to the pin promotes wide deflection to that portion of the ion beam within the grid spacing. Unlike other gates (e.g. the Bradbury-Nielsen gate), the pulse pin ion gate 300 is simple to fabricate, requires only a single high voltage pulse, and has an adjustable "window" by variation in the surrounding grid spacing.

The pulsed pin ion gate 300 may be made of any conductive material, such as copper. Grid A 306 and grid B 308 can be made of any material that can be used to make high transmission gates, e.g. a nickel mesh.

As depicted in FIG. 7, the linear detector 204 and reflectron detector 206 are channel plate detectors. As depicted in FIG. 7, both the linear and reflectron channel plate detector include two channel plates that are held together by a clamp. The channel plates are held at a negative potential. When an ion impacts the channel plate, the channel plate releases electrons that propagate to the second channel plate, and induce a signal in an output electrode. The pin electrode propagates the signal to detection electronics (such as an oscilloscope).

In various additional embodiments, one or more channel plates can be configured in detectors. Two, three, or more channel plates can be held together.

As depicted in FIG. 6, the wire ring ion reflectron 116 uses a cylindrically framed instrument structure. The reflectron can be any type of reflectron known in the art, including a linear reflectron, or a non-linear reflectron such as a curved field reflectron.

The wire ring reflectron 116 includes an electrically non-conductive cylindrical frame 124, with a plurality of conductive wire elements 126 each surrounding the cross section of the cylindrical frame to create a cylindrical wire ring reflectron 116 having a proximal end 128 and a distal end 130. Each adjacent wire element is electrically connected by a resistors (not shown), such as a variable resistor or a constant resistor.

It is noted that cylindrical reflectron requires only that the rings, optionally wire rings, surround the center axis of the reflectron. Thus, each wire ring can be a series of straight sections surrounding the reflectron and still be considered cylindrical. The cylindrical shape can be, e.g., pentagonal, hexagonal, heptagonal, octagonal, etc. and still be considered cylindrical.

In a linear reflectron, the potential at the center of the reflectron increases linearly from the proximal end of the reflectron as a function of distance into the reflectron. In certain embodiments, both the resistance and distance between elements is constant. In non-linear reflectrons, the potential at the center of the reflectron increases non-linearly with an increasing slope from the proximal end to the distal end of the reflectron. In one embodiment, this can be accomplished when each successive resistor between elements from the proximal end to the distal end of the reflectron has a decreased resistance. In another embodiment, this can be accomplished when the distance between each wire elements decreases from the proximal end of the reflectron to the distal end of the reflectron.

Figure 9:
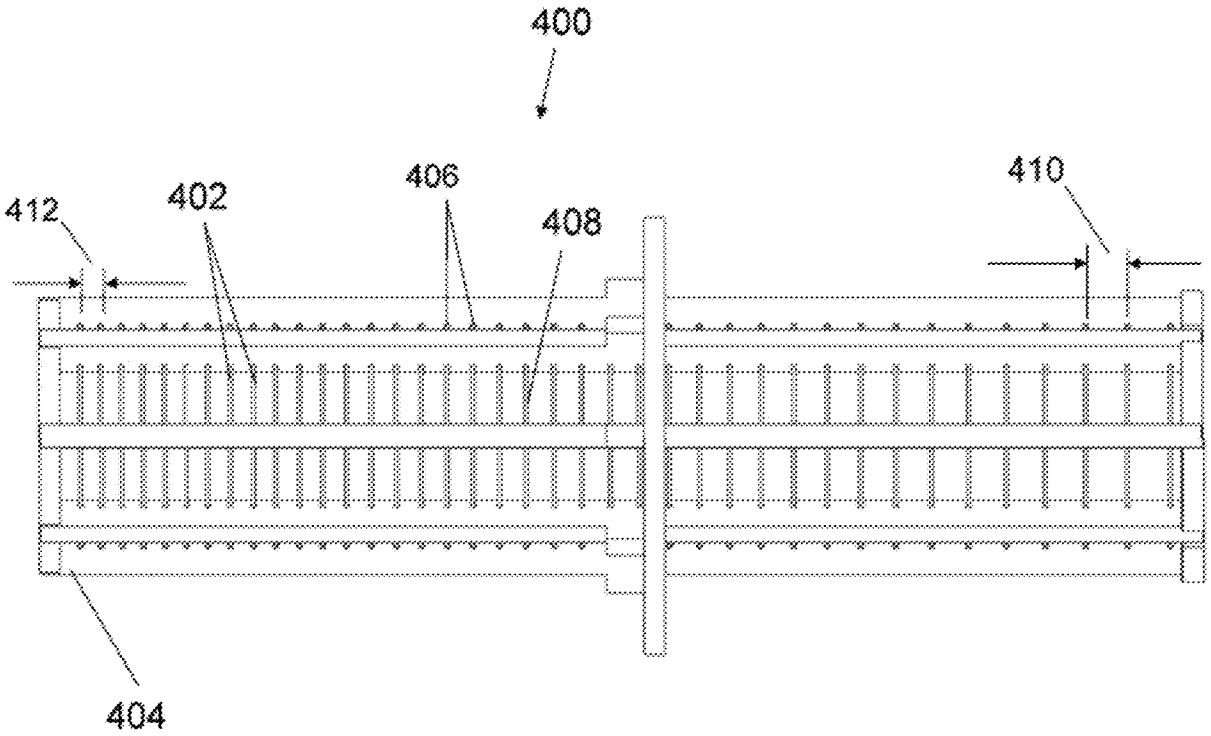
FIG. 9 is a side view of a wire ring reflectron, according to an illustrative embodiment.

An embodiment of the wire ring reflectron is depicted in FIG. 9. As depicted in FIG. 9, the wire ring ion reflectron is a curved field reflectron (CFR). The curved field energy-focuses ions formed after initial acceleration in time-of-flight (TOF) mass spectrometers. Typically, the ions are formed in the field-free drift region prior to their reflection. The focal lengths of the reflected ions in the CFR are not proportional to the mass (energy) of the fragment, and instead focuses post-source decay ions at the reflectron detector. The first two rings have a greater spacing distance 410 than the last two rings 412. Thus, fragment peaks are resolved without scanning or stepping the potential gradient of the reflectron. An example of such a CFR is described in U.S. Pat. No. 5,464,985, which is incorporated herein by reference.

The reflection rails can be made of any non-conductive material, such as polycarbonate. The ring elements can be made of any conductive material, including wire (e.g. copper wire).

In the design of FIG. 9, the curved field reflectron is achieved by placing a series of ring elements, each separated by a constant resistance. The potential of each ring element increases stepwise toward the rear of the reflectron. However, each successive ring element is spaced more closely than the previous ring. Thus, the potential affecting ions at the center of the reflectron increases non-linearly due to spacing of elements.

In the embodiment depicted in FIG. 9, each element of the reflectron 400 is constructed out of a wire ring 402. Each element can be circular, or another shape such as hexagonal. The wire ring can be wound around a support structure 404, or can be designed to allow a series of holes 406 to be drilled for accommodation of conductor wire loops 408 to be threaded through the holes 406 forming the ion reflector elements.

The support structure 404 can be made out of any material known in the art suitable for a non-conductive support structure. The support structure 404 can be selected from materials that have lower amounts of outgassing to allow lower vacuums in the mass spectrometer. The support structure 404 can further be selected from lightweight components to allow for improved portability. The support structure 404 can also be designed for rigid materials for rugged use associated with various applications.

The materials for the reflectron provide a lightweight design suitable for instrument portability. The open architecture allows rapid pumping, and the variable spacing in the hole pattern to fabricate non-linear ion reflectrons.

In various embodiments, any number of ring elements can be included.

The integrated design of the detector block allows for simple assembly and repair, low fabrication cost, and a highly ruggedized package made primarily from lightweight components, such as plastic. The pulsed pin ion gate requires only a single HV pulse for operation, and the single copper pin is easily fitted into the detector block assembly. Wire frame reflectron features a lightweight design, open architecture for rapid pumping, and simple accommodation of variable spacing in the hole pattern to fabricate non-linear ion reflectors.

In various applications, the channel plates in the detector have the same potential as the drift region. Examples of such potentials are 1 kV, 2 kV, 2.7 kV, 3 kV, or 4 kV. If the flight tube is at the same potential as the channel plate and the reflectron potentials are designed relative to the channel plates, no grid is required in front of the channel plate in order to keep the potential of the channel plate from affecting the time of flight of the ions. The design therefore provides less potential for arcing between the detector and grid in operation. The design also allows increased transmission of ions due to the absence of any grid that would inhibit transmission. The pin anode used in the detector can be at ground. That way, when the electrons hit the surface, the pin is at ground potential allowing for easier coupling to the detection electronics. Gating potentials for the pulsed pin ion gate can be any potential that varies from the potential of the drift region.

In various additional embodiments, grids can be placed in front of each channel plate detector. The grids are kept at the same potential as the rest of the instrument. The potential difference between the grid and the channel plate allows for increased potential applied to the channel plate, and therefore a larger detection signal and increased sensitivity for post-source detection of product ions. Such embodiments allow the drift region to have a zero potential. In various additional applications, the drift region of the instrument can be at a non-zero potential. When grids are used at the detectors, post acceleration of the ions before they hit the detector, provides higher sensitivity.

Applications

The miniature TOF-MS described herein, and its components, provide a highly efficient field portable instrument. The completed miniature TOF-MS features simple operation, rapid analysis time, relatively inexpensive purchase price (compared to Lab Scale instruments of comparable capabilities).

The field portability of the miniature TOF-MS disclosed herein can be used for a variety of applications. The mass spectrometer, and/or components thereof, can be used to detect volatile and non-volatile analytes.

In some aspects, the miniature TOF-MS can be used to detect non-volatile (refractory) and biological materials on landed planetary missions. Both atmospheric and airless bodies are potential candidate destinations for the purpose of characterizing mineralogy, and searching for evidence of existing or extant biological activity. Applications include detection of weapons of mass destruction, as well as chemical and bioterrorism components. Components of nuclear forensics can be detected at high efficiency. The device can be used in forensic analysis, agricultural analysis (e.g. detection of plant pathogens, soil contamination, fertilizer management), and oceanographic Analysis (e.g. detection of harmful algal bloom detection and verification).

EXAMPLES

The following non-limiting examples are for illustration purposes only, and do not limit the scope of the disclosure herein.

Figure 10A:
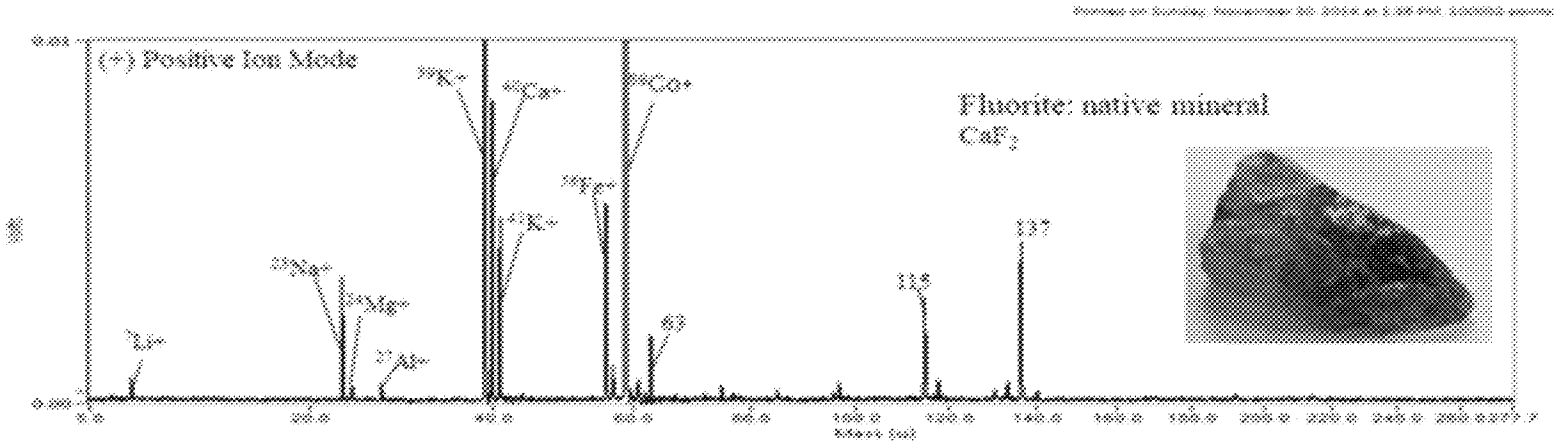
FIG. 10A is a mass spectra of a native mineral of calcite ($CaF_2$) acquired in positive ion mode, according to an illustrative embodiment.
Figure 10B:
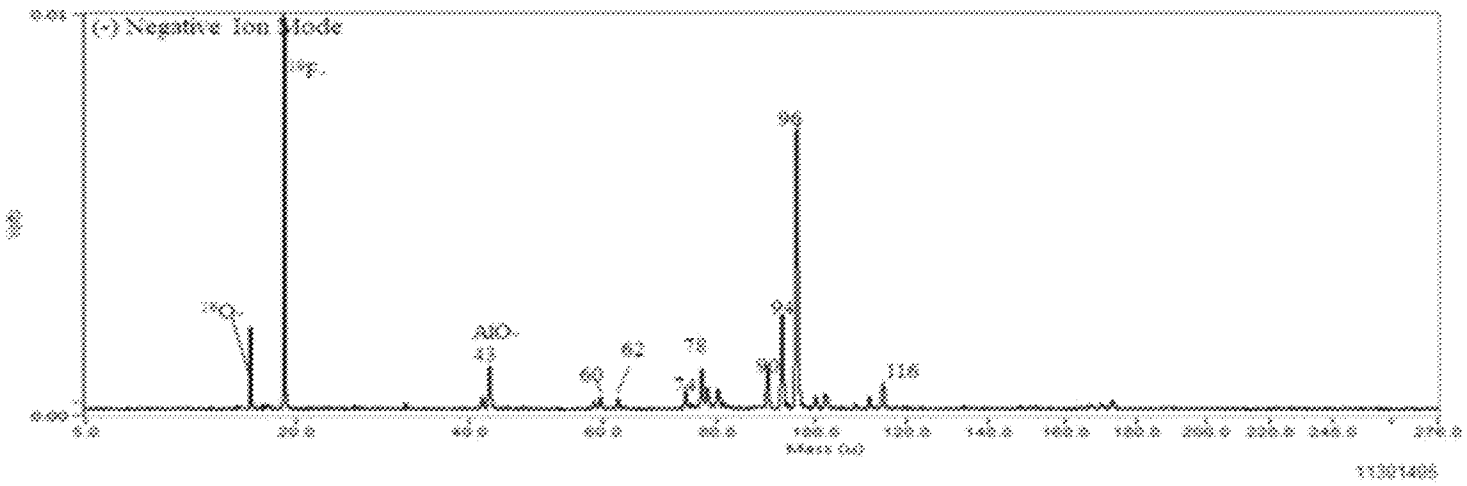
FIG. 10B is a mass spectra for the native mineral of FIG. 10A, but acquired in negative ion mode.

Now referring to FIG. 10A, a mass spectra is presented of a native mineral of calcite ($CaF_2$) acquired in positive-ion mode, according to an illustrative embodiment. FIG. 10B presents a mass spectra for the native mineral of FIG. 10A, but acquired in negative-ion mode. A core sample of the native mineral was extracted using a 1.5 mm, diamond-coated coring drill bit that was subsequently inserted into a TOF mass spectrometer. The insertion process was facilitated by a sample-holding assembly, such as that described in relation to FIGS. 1-4. The abscissa of each mass spectra ranges from about 5μ to 277μ and quantifies a mass of chemical constituents ablated from the core sample. The ordinate of each mass spectra ranges from 0 to 0.01 V and quantifies a charge signal from each of the ablated chemical constituents.

The mass spectra of FIG. 10A indicates the relative presence of various positively-charged ions. In particular, the mass spectra contains sharp peaks for $^{7}Li^{+}$, $^{23}Na^{+}$, $^{24}Mg^{+}$, $^{27}Al^{+}$, $^{39}K^{+}$, $^{40}Ca^{+}$, $^{56}Fe^{+}$, $^{59}Co^{+}$, and various other unidentified positively-charged ions. Similarly, the mass spectra of FIG. 20B indicates the relative presence of negatively-charged ions. This mass spectra contains sharp peaks for $^{16}O^-$, $^{29}F^-$, $AlO^-$, and various other unidentified negatively-charged ions. The well-defined peaks of FIGS. 10A & 10B show that data acquired using coring drill technology are of exceptional quality.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A method of detecting a sample comprising:

drilling, into a solid sample, with a component comprising an internal cavity configured to contain a sample to form a core sample-containing component;

placing the core sample-containing component in a source region of a mass spectrometer such that the sample is flush with a backing plate of the source region and positioned to be ionized by ionizing radiation; and ionizing material from the sample; and obtaining a mass spectrum using a time-of-flight mass analyzer operably associated with the source region.

2. The method of claim 1, wherein the core sample-containing component comprises a coring drill bit.

3. The method of claim 1, wherein the core sample-containing component is configured to couple to the backing plate of the source region from the opposite side of an acceleration region.

4. The method of claim 1, wherein the core sample-containing component is configured to couple to the source region on an acceleration region side of the backing plate.

5. The method of claim 4, wherein the acceleration region is a single-stage acceleration region.

6. The method of claim 4, wherein the acceleration region is a two-stage acceleration region.

7. The method of claim 1, wherein the sample is placed in the source region without removing the sample from the core sample-containing component.

8. The method of claim 1, wherein the sample is placed in the source region without preparing a slurry of the sample.

9. The method of claim 1, wherein the sample is placed in the source region without dissolving the sample.

10. The method of claim 1, wherein the sample is placed in the source region without dissolving the sample.

* * * * *